US011028658B2

(12) United States Patent
Feng et al.

(10) Patent No.: US 11,028,658 B2
(45) Date of Patent: Jun. 8, 2021

(54) HORIZONTAL-TO-VERTICAL DRILLING MODULE FOR DEEP WELL

(71) Applicants: China National Offshore Oil Corporation, Beijing (CN); China Oilfield Services Limited, Tianjin (CN)

(72) Inventors: Yongren Feng, Langfang (CN); Jibin Zou, Langfang (CN); Tiemin Liu, Langfang (CN); Xingfang Wu, Langfang (CN); Xiaodong Chu, Langfang (CN); Zhibin Tian, Langfang (CN); Guoqiang Zhang, Langfang (CN); Zhongtian Hao, Langfang (CN); Guangshuai Li, Langfang (CN); Yiming Wu, Langfang (CN)

(73) Assignees: China National Offshore Oil Corporation, Beijing (CN); China Oilfield Services Limited, Tianjin (CN)

( * ) Notice: Subject to any disclaimer, the term of this patent is extended or adjusted under 35 U.S.C. 154(b) by 0 days.

(21) Appl. No.: 16/760,034

(22) PCT Filed: Mar. 25, 2019

(86) PCT No.: PCT/CN2019/079522
§ 371 (c)(1),
(2) Date: Apr. 28, 2020

(87) PCT Pub. No.: WO2020/062810
PCT Pub. Date: Apr. 2, 2020

(65) Prior Publication Data

US 2020/0291735 A1 Sep. 17, 2020

(30) Foreign Application Priority Data

Sep. 27, 2018 (CN) ..... 201811134211.9

(51) Int. Cl.
*E21B 25/10* (2006.01)
*E21B 49/02* (2006.01)

(52) U.S. Cl.
CPC ..... *E21B 25/10* (2013.01); *E21B 49/02* (2013.01)

(58) Field of Classification Search
CPC ..... E21B 49/02; E21B 49/06; E21B 25/10
See application file for complete search history.

(56) References Cited

U.S. PATENT DOCUMENTS 2,599,405 A 6/1952 Mennecier
4,396,074 A 8/1983 Jageler et al.
(Continued)

FOREIGN PATENT DOCUMENTS

CN 101498200 A 8/2009
CN 201522998 U 7/2010
(Continued)

OTHER PUBLICATIONS

Office Action dated Jun. 25, 2019 for Chinese Patent Application No. 201811134211.9 and English Translation.

*Primary Examiner* — D. Andrews
(74) *Attorney, Agent, or Firm* — Ling Wu; Stephen Yang; Ling and Yang Intellectual Property

(57) ABSTRACT

A horizontal-to-vertical drilling module for a deep well includes a fixed plate (1) provided with a first guide hole having a turning section (11), a core breaking section (13) and a moving section (12); a movable plate (2) movably mounted on one side of the fixed plate and provided with a second guide hole having a turning driving section (21), a core breaking driving section (23) and a moving driving section (22), the projection of the first guide hole on the movable plate intersecting with the second guide hole; a coring module (3) positioned at the other side of the fixed plate and provided with a moving column (31) on the side
(Continued)

facing the fixed plate; and a moving slider (4) having an open groove (41), the moving slider being installed in the first guide hole and rotatably connected to the coring module.

11 Claims, 9 Drawing Sheets

(56) References Cited

U.S. PATENT DOCUMENTS

| | | | | | |
|---|---|---|---|---|---|
| 4,449,593 | A | * | 5/1984 | Jageler | E21B 49/06 175/58 |
| 4,461,360 | A | | 7/1984 | Mount, II | |
| 4,714,119 | A | * | 12/1987 | Hebert | E21B 49/06 175/20 |

FOREIGN PATENT DOCUMENTS

| | | | |
|---|---|---|---|
| CN | 204344032 | U | 5/2015 |
| CN | 105298420 | A | 2/2016 |
| CN | 106223885 | A | 12/2016 |
| CN | 205955730 | U | 2/2017 |
| CN | 207673333 | U | 7/2018 |
| CN | 109138883 | A | 1/2019 |
| JP | 6388306 | B2 | 9/2018 |

* cited by examiner

HORIZONTAL-TO-VERTICAL DRILLING MODULE FOR DEEP WELL

CROSS-REFERENCE TO RELATED APPLICATIONS

The present application is a U.S. National Phase Entry of International PCT Application No. PCT/CN2019/079522 having an international filing date of Mar. 25, 2019, which claims priority to Chinese Patent Application No. 201811134211.9 filed on Sep. 27, 2018. The present application claims priority and the benefit of the above-identified applications and the above-identified applications are incorporated by reference herein in their entirety.

TECHNICAL FIELD

The present disclosure relates to, but is not limited to, mechanical equipment technology, in particular to a horizontal-to-vertical drilling module for a deep well.

BACKGROUND

At present, one type of conventional mechanical borehole wall coring tool uses a hydraulic pump to drive a hydraulic motor which in turn drives a drill bit to drill a core, and another type uses the driving force provided by an electric motor to drive the drill bit to drill a core.

The hydraulic motor and electric motor only provide power for coring operation. To perform the coring operation, a specially designed guide plate is needed to be provided to guide the hydraulic motor or electric motor to carry out the coring operation. The drilling guide plate needs to be developed and designed according to the structure of the hydraulic motor or electric motor, and thus it is difficulty to design and the designed guide plates are substantially different from each other.

The electric motor coring technology uses the electric motor to directly drive the reducer which in turn drives the drill bit to perform coring operation. The rotating pin (equivalent to the moving column in this disclosure) that performs coring action is located on the casing of the reducer body, and the electric motor needs to rotate with it. The produced coring tool needs to have the functions of coring, core breaking, turning, core pushing, etc., which makes its design difficult and has always puzzled those skilled in the art.

SUMMARY

The following is a summary of the subject matter described in detail in this disclosure, and this summary is not intended to limit the protection scope of the claims.

This disclosure provides a horizontal-to-vertical drilling module for a deep well comprising: a fixed plate provided with a first guide hole having a turning section, a core breaking section and a moving section positioned between the turning section and the core breaking section; a movable plate movably mounted on one side of the fixed plate and provided with a second guide hole having a turning driving section, a core breaking driving section and a moving driving section positioned between the turning driving section and the core breaking driving section, wherein the projection of the first guide hole on the movable plate intersects with the second guide hole; a coring module positioned at the other side of the fixed plate and provided with a moving column on the side facing the fixed plate, wherein the moving column extends into the second guide hole through the first guide hole; and a moving slider having an open groove, wherein the moving slider is installed in the first guide hole and rotatably connected to the coring module, and the moving column may slide into and out of the open groove; wherein the coring module is movable in the moving section and the core breaking section; wherein the turning driving section is able to drive the moving column to move from the turning section to the moving section and slide into the open groove, and is also able to drive the moving column to slide out of the open groove and move from the moving section into the turning section; wherein the moving driving section is able to drive the coring module and the moving column positioned in the open groove to move together in the moving section and the core breaking section; and wherein the core breaking driving section is able to drive the moving column to press against the inner wall of the open groove in the core breaking section to perform core breaking.

Other features and advantages of the technical schemes of the present disclosure will be set forth in the following description, and partly become more apparent from the description, or be understood by implementing the technical schemes of the present disclosure. The purposes and other advantages of the technical schemes of the present disclosure can be achieved and obtained by means of the structures specifically indicated in the description, claims and drawings.

BRIEF DESCRIPTION OF DRAWINGS

Drawings are provided for further understanding of the technical schemes of the present disclosure and constitute a part of the specification, and together with the embodiments are used for explaining the technical schemes of the disclosure, which do not limit the technical schemes of the disclosure.

The correspondence between reference numbers and component names in FIGS. 1 to 10 is as follows:

1—fixed plate, 11—turning section, 12—moving section, 13—core breaking section, 14—third guide hole, 15—guide rail groove, 2—movable plate, 21—turning driving section, 22—moving driving section, 23—core breaking driving section, 24—position constraining part, 25—turning positioning section, 26—guide rail, 3—coring module, 31—moving column, 32—mounting shaft, 4—moving slider, 41—open groove, 410—outer bottom surface, 5—core breaking resetting module, 51—movable beam, 52—resetting member, 521—positioning block, 522—piston, 523—elastic resetting piece, 524—blocking piece, 61—first cross beam, 62—second cross beam.

DETAILED DESCRIPTION

Hereinafter, embodiments of the present disclosure will be described in detail with reference to the accompanying drawings. It should be noted that the embodiments in the present disclosure and the features in the embodiments can be combined with each other in any way unless there is a contradiction.

In the following description, numerous specific details are set forth in order to fully understand the technical schemes of the present disclosure. However, the technical schemes of the present disclosure may also be implemented in other ways different from those described herein. Therefore, the protection scope of the present disclosure is not limited by the specific embodiments disclosed below.

Figure 1:
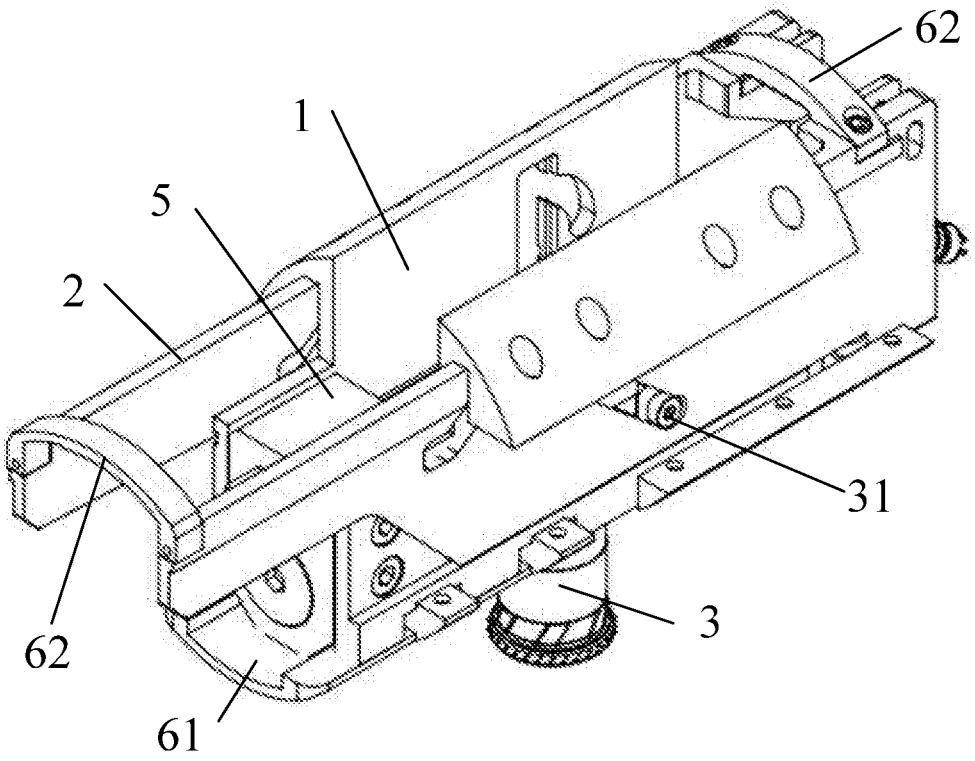
FIG. 1 is a schematic perspective structural view of a horizontal-to-vertical drilling module for a deep well according to one embodiment of the disclosure.
Figure 2:
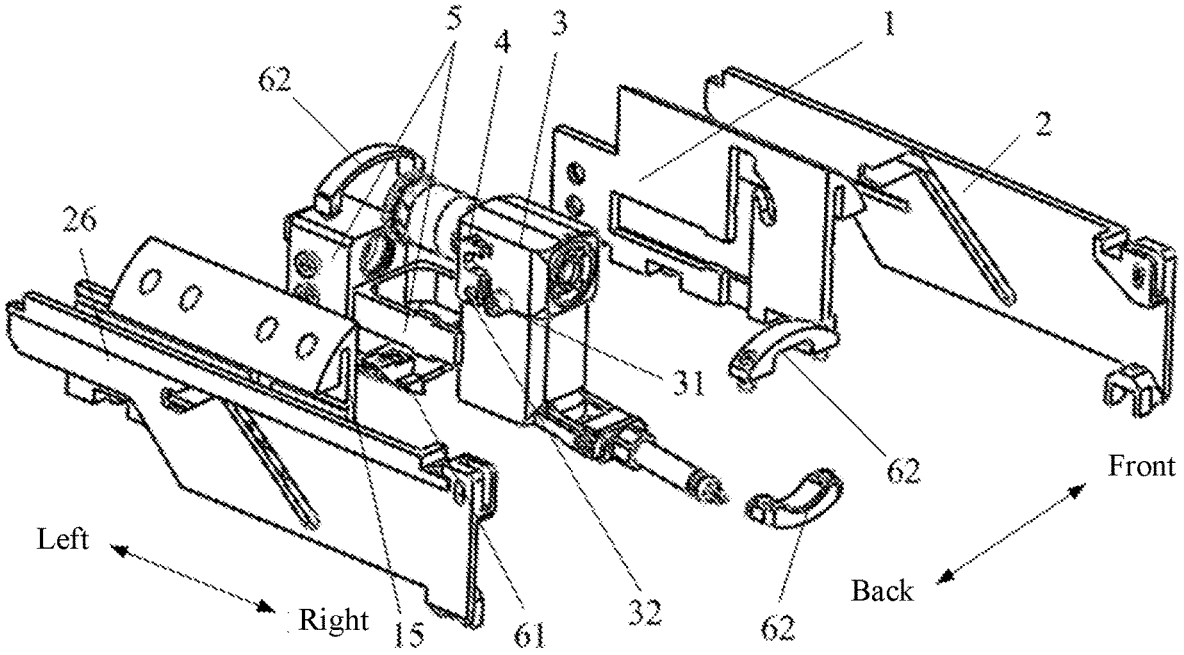
FIG. 2 is a schematic exploded structural view of the horizontal-to-vertical drilling module for a deep well shown in FIG. 1.
Figure 3:
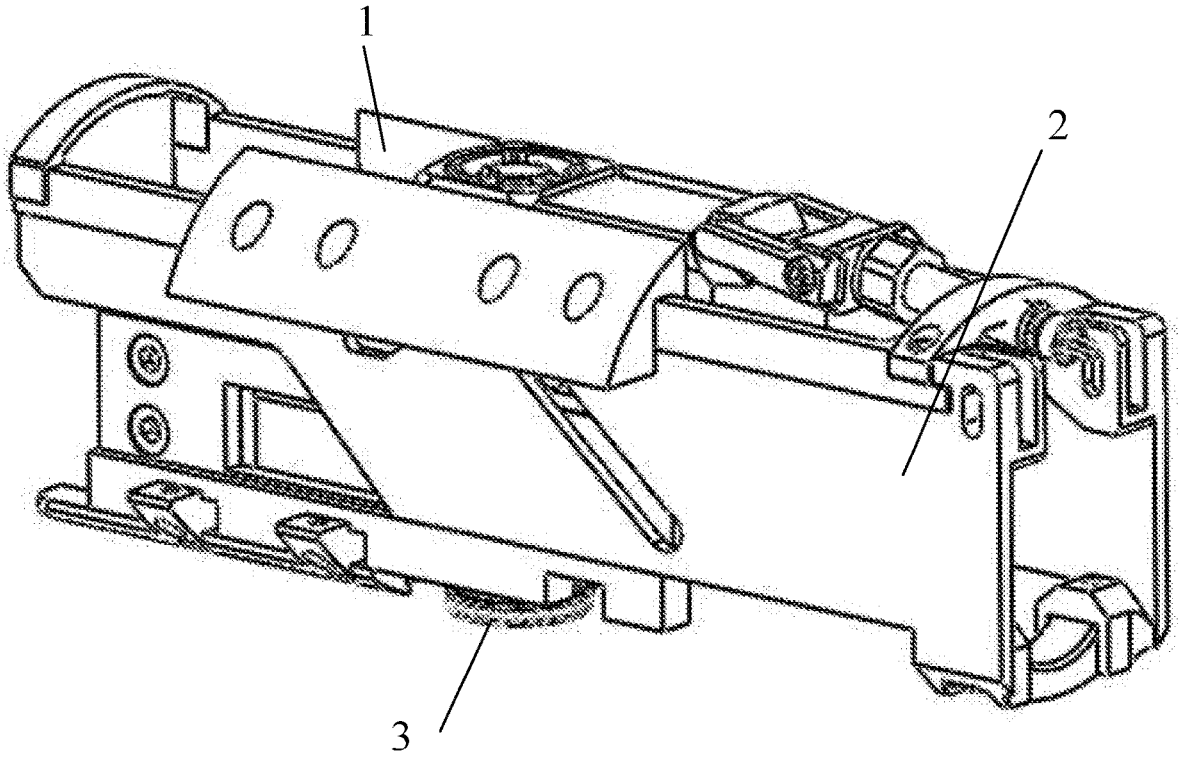
FIG. 3 is a schematic structural view of a state of the horizontal-to-vertical drilling module for a deep well shown in FIG. 1, which is being moved vertically.
Figure 4:
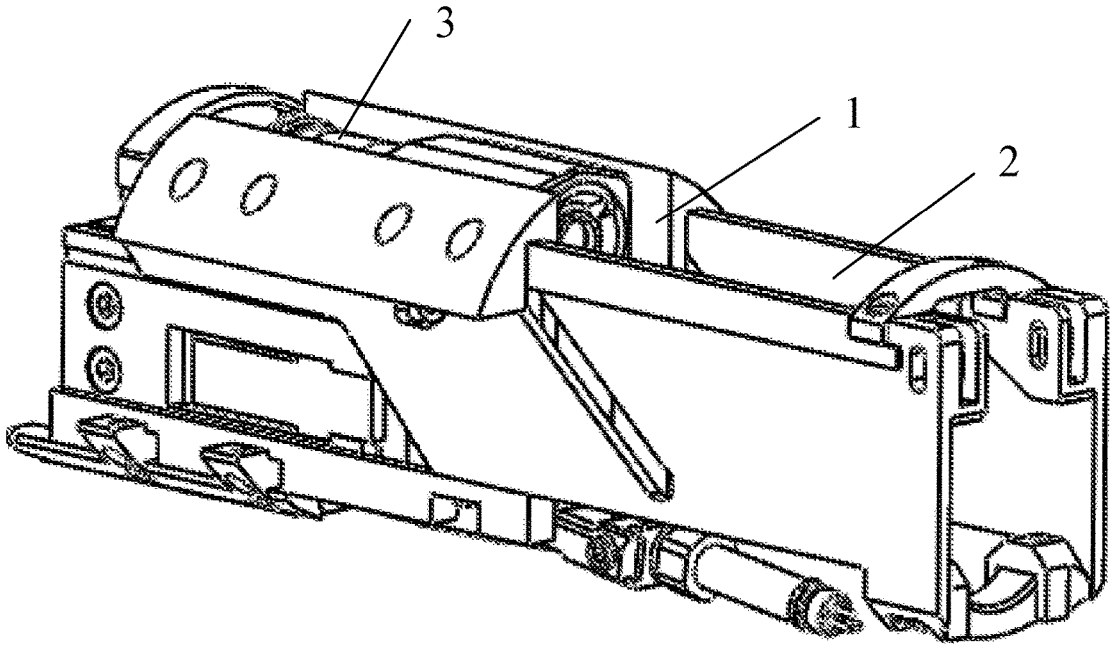
FIG. 4 is a schematic structural view of the horizontal-to-vertical drilling module for a deep well shown in FIG. 1, which is turned to a horizontal state.
Figure 7:
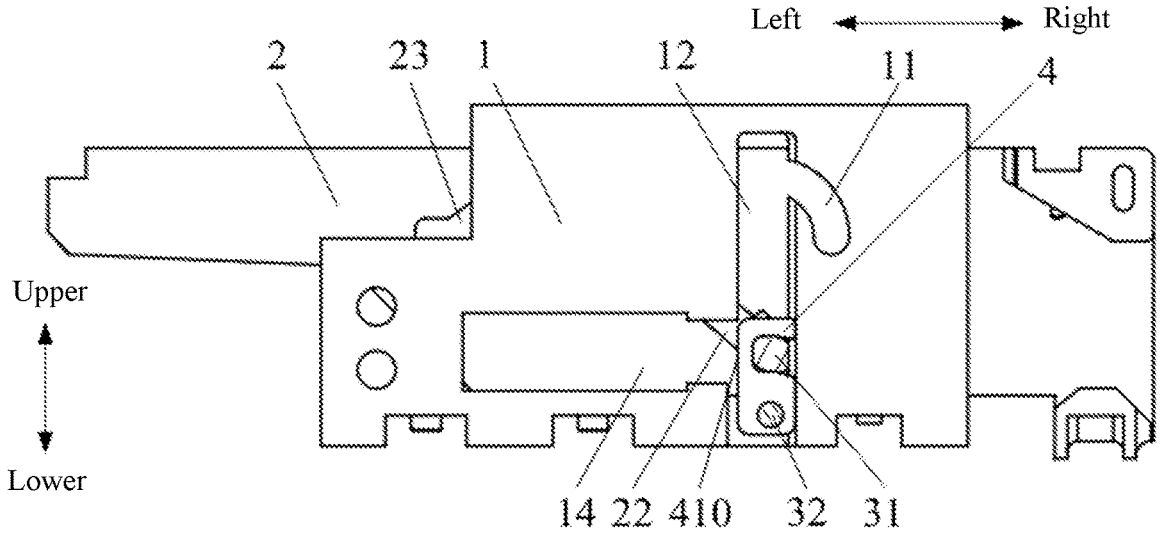
FIG. 7 is a sectional partial structural view of the horizontal-to-vertical drilling module for a deep well shown in FIG. 6.
Figure 8:
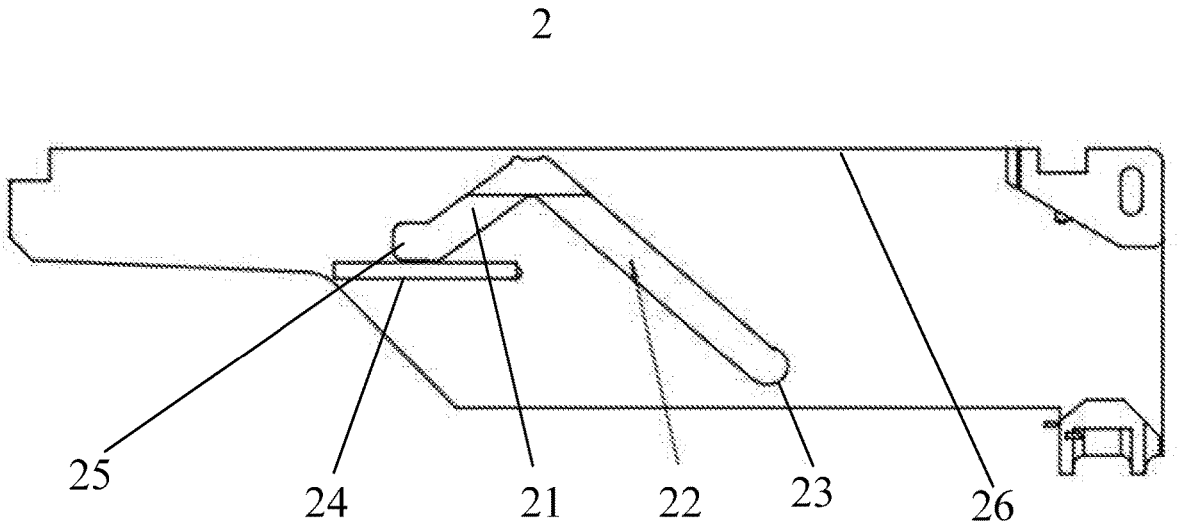
FIG. 8 is a schematic structural view of the side of the movable plate in FIG. 1 facing the fixed plate.
Figure 9:
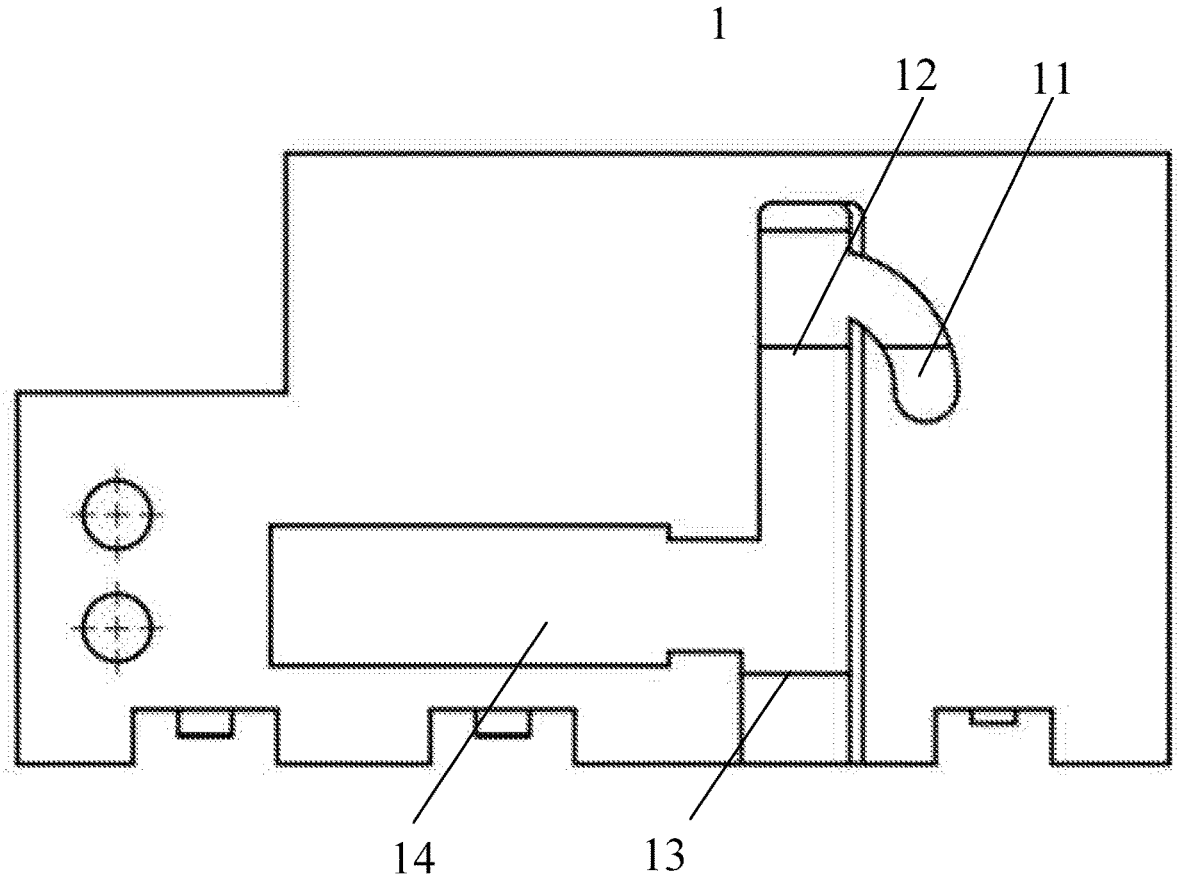
FIG. 9 is a schematic perspective structural view of the fixed plate in FIG. 1.
Figure 10:
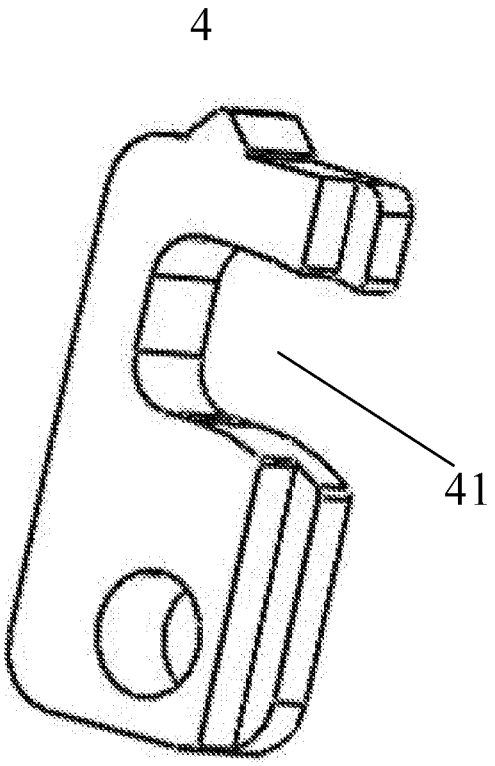
FIG. 10 is a schematic perspective structural view of the moving slider of FIG. 1.

As shown in FIGS. 1 to 10, the horizontal-to-vertical drilling module for a deep well provided by the present disclosure includes a fixed plate 1, a movable plate 2, a coring module 3 and a moving slider 4. As shown in FIG. 9, the fixed plate 1 is provided with a first guide hole having a turning section 11, a core breaking section 13 and a moving section 12 positioned between the turning section 11 and the core breaking section 13. The movable plate 2 is movably installed on one side of the fixed plate 1, and as shown in FIG. 8, is provided with a second guide hole having a turning driving section 21, a moving driving section 22 and a core breaking driving section 23. The moving driving section 22 is located between the turning driving section 21 and the core breaking driving section 23. The projection of the first guide hole on the movable plate 2 intersects with the second guide hole. The coring module 3 as shown in FIG. 2 is located on the other side of the fixed plate 1, and the side thereof facing the fixed plate 1 is provided with a moving column 31 and a mounting shaft 32. The moving column 31 extends into the second guide hole through the first guide hole. The moving slider 4 as shown in FIG. 10 has an open groove 41 and is installed in the first guide hole and rotatably connected to the mounting shaft 32 of the coring module 3. The moving column 31 can slide into and out of the open groove 41. The coring module 3 can move in the moving section 12 and the core breaking section 13. The turning driving section 21 can drive the moving column 31 to move from the turning section 11 to the moving section 12 and slide into the open groove 41. The turning driving section 21 can also drive the moving column 31 to slide out of the open groove 41 and move from the moving section 12 into the turning section 11. The moving driving section 22 can drive the coring module 3 and the moving column 31 located in the open groove 41 to move together in the moving section 12 and the core breaking section 13. The core breaking driving section 23 can drive the moving column 31 to press the inner wall of the open groove 41 in the core breaking section 13 to perform core breaking.

With respect to the horizontal-to-vertical drilling module for a deep well, the fixed plate 1 is provided with a first guide hole having a turning section 11, a core breaking section 13 and a moving section 12 positioned between the turning section 11 and the core breaking section 13. The movable plate 2 is movably installed on one side of the fixed plate 1, and is provided with a second guide hole having a turning driving section 21, a moving driving section 22 and a core breaking driving section 23. The moving driving section 22 is located between the turning driving section 21 and the core breaking driving section 23. The projection of the first guide hole on the movable plate 2 intersects with the second guide hole. The coring module 3 is located on the other side of the fixed plate 1, and the side thereof facing the fixed plate 1 is provided with a moving column 31. The moving column 31 extends into the second guide hole through the first guide hole. The moving slider 4 is installed in the first guide hole and rotatably connected to the coring module 3. The moving slider 4 is provided with an open groove 41 and the moving column 31 can slide into and out of the open groove 41. The horizontal-to-vertical drilling module for a deep well is simple in structure and can realize the coring, core breaking, turning and core pushing actions, thereby meeting the usage requirement better.

The coring module 3 can move in the moving section 12 and the core breaking section 13, and can move from the moving section 12 into the turning section 11.

Turning action is as follows. The moving slider 4 is located at the end of the moving section 12 adjacent to the turning section 11, and the moving column 31 is located in the open groove 41. By moving the movable plate 2 in a first direction, the turning driving section 21 drives the moving column 31 to slide out of the open groove 41 and move from the moving section 12 into the turning section 11, thus realizing turning the coring module 3 from the vertical state to the horizontal state (The vertical state and the horizontal state are only for better explanations of the present disclosure, and are not mandatory limitations to the present disclosure. The coring module 3 can be in other states, i.e., turned from a first state to a second state, switched from the state shown in FIG. 3 to the state shown in FIG. 4). By moving the movable plate 2 in a direction opposite to the first direction, the turning driving section 21 drives the moving column 31 to move from the turning section 11 to the moving section 12 and slide into the open groove 41, thus turning the coring module 3 from the horizontal state to the vertical state (from the state shown in FIG. 4 to the state shown in FIG. 3).

Moving action (which can be understood in conjunction with FIGS. 3, 7 to 9) is as follows. The moving driving section 22 can drive the coring module 3 and the moving column 31 located in the open groove 41 to move together in the moving section 12 and the core breaking section 13. The moving column 31 and the moving slider 4 can move together from the moving section 12 to the core breaking section 13 (the coring module 3 is in a vertical state), or the moving column 31 and the moving slider 4 can move together from the core breaking section 13 to the moving section 12 (the coring module 3 is in a vertical state).

Core breaking action is as follows. The moving slider 4 is located in the core breaking section 13 (the coring module 3 is in a vertical state), and the moving column 31 is located in the open groove 41. The core breaking driving section 23 drives the moving column 31 to press the inner wall of the open groove 41 in the core breaking section 13 to perform core breaking. The coring module 3 turns slightly (e.g., the set angle can be 3-5 degrees, etc.) about its hinge axis where it is hinged to the moving slider 4, accomplishing the core breaking action (which can be understood with reference to FIGS. 6 and 7).

In addition, as shown in FIGS. 1 and 2, the horizontal-to-vertical drilling module for a deep well further includes a core breaking resetting module 5 installed beside the core breaking section 13 and configured to reset the moving column 31 and the moving slider 4 after core breaking, so as to ensure the use stability of the horizontal-to-vertical drilling module for a deep well and ensure that the horizontal-to-vertical drilling module for a deep well can be continuously used for coring.

As shown in FIGS. 2, 5, 7 and 9, the core breaking resetting module 5 may include a movable beam 51 and a resetting member 52. The fixed plate 1 is further provided with a third guide hole 14 communicated with the core breaking section 13, and the movable beam 51 is movably installed in the third guide hole 14. The end of the movable beam 51 remote from the core breaking section 13 is connected to the resetting member 52. The resetting member 52 is configured to reset the moving slider 4 and the moving column 31 to a vertical state so that they are able to smoothly move from the core breaking section 13 into the moving section 12 in subsequent actions. The movable beam 51 is pressed against the outer bottom surface 410 of the open groove 41 when the moving slider 4 is positioned in the core breaking section 13.

Specifically, as shown in FIGS. 2, 5, 5*a* and 5*b*, the resetting member 52 includes a positioning block 521, a piston 522, an elastic resetting piece 523, and a blocking piece 524. The positioning block 521 is fixedly connected with the fixed plate 1, and is provided with a piston cavity and a mounting cavity communicated with each other. The mounting cavity has an opening facing the movable beam 51. The piston 522 is movably installed in the piston cavity in a sealed and position constrained manner. The elastic resetting piece 523 is installed in the mounting cavity. The blocking piece 524 is movably installed in the opening of the mounting cavity in a sealed and position constrained manner and presses tightly against the elastic resetting piece 523. The movable beam 51 is connected to the blocking piece. The piston cavity and the mounting cavity are filled with hydraulic oil. During core breaking, the moving slider 4 pushes the blocking piece 524 to move toward the inside of the mounting cavity through the movable beam 51, and the piston 522 moves toward the outside of the piston cavity. When the core breaking force exerted by the movable plate 2 is removed, the elastic resetting piece 523 pushes the blocking piece 524 toward the outside of the mounting cavity, and the blocking piece 524 pushes the moving slider 4 to rotate to a vertical state (i.e., a state in which core breaking is not performed) through the movable beam 51, meanwhile the piston 522 moves toward the inside of the piston cavity. Such structure can prevent the positioning block from being crushed under the external environment high pressure. The elastic resetting piece 523 may be any one of a disc spring and equivalent components thereof.

Figure 5:
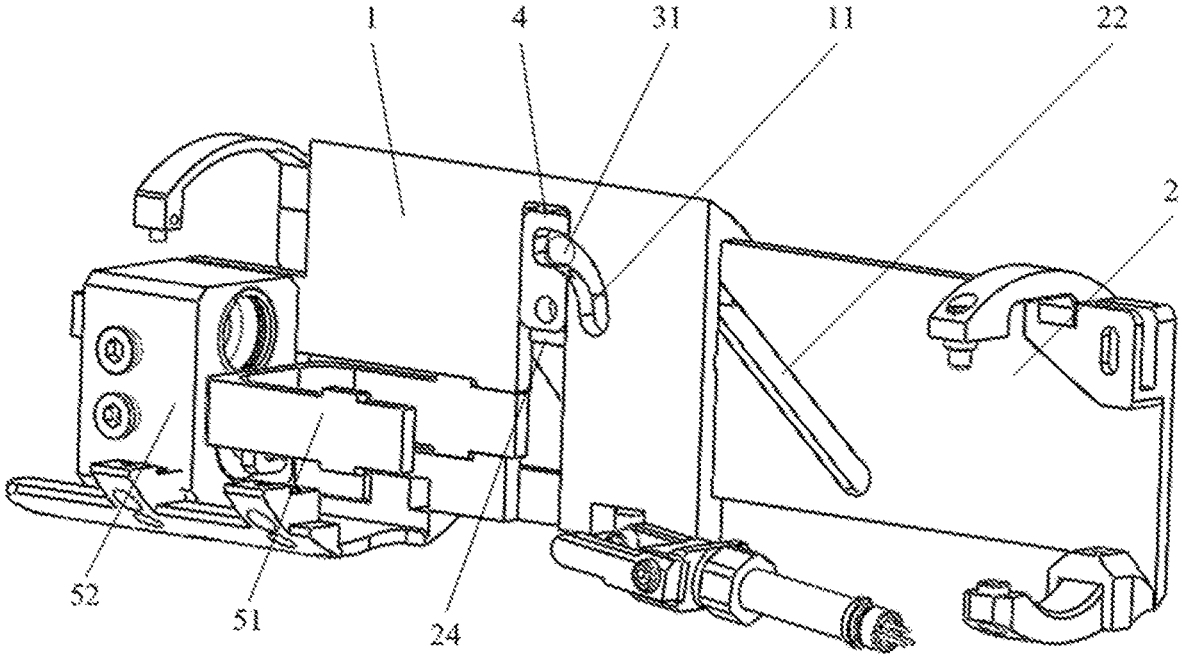
FIG. 5 is a schematic sectional partial structural view of a state of the horizontal-to-vertical drilling module for a deep well shown in FIG. 4, which is being turned from a vertical state to a horizontal state.
Figure 5A:
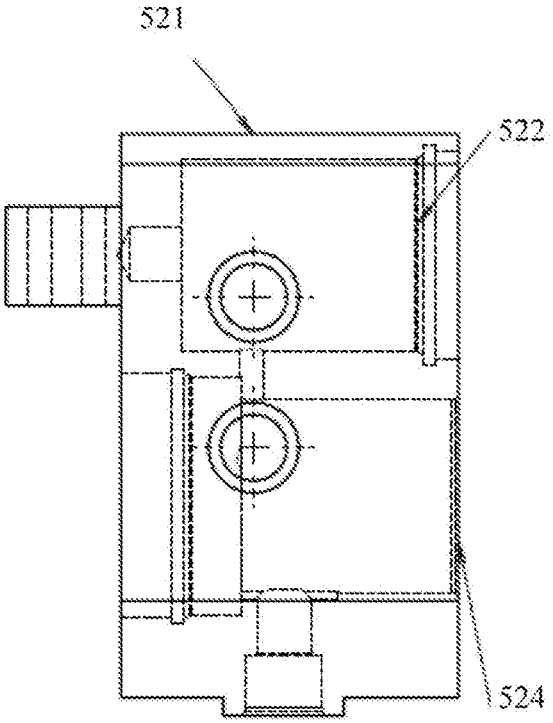
FIGS. 5*a* and 5*b* are schematic structural views of the resetting member 52 shown in FIG. 5.
Figure 5B:
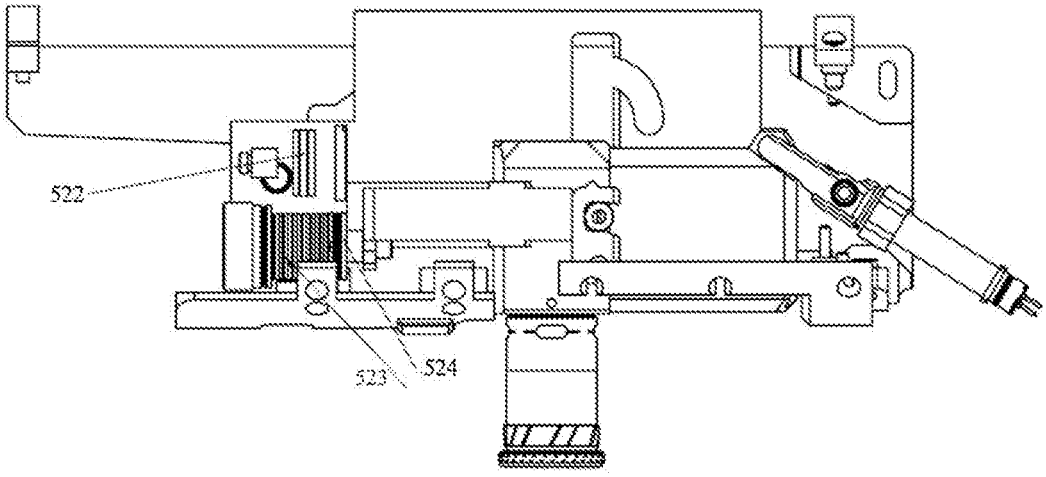
Figure 6:
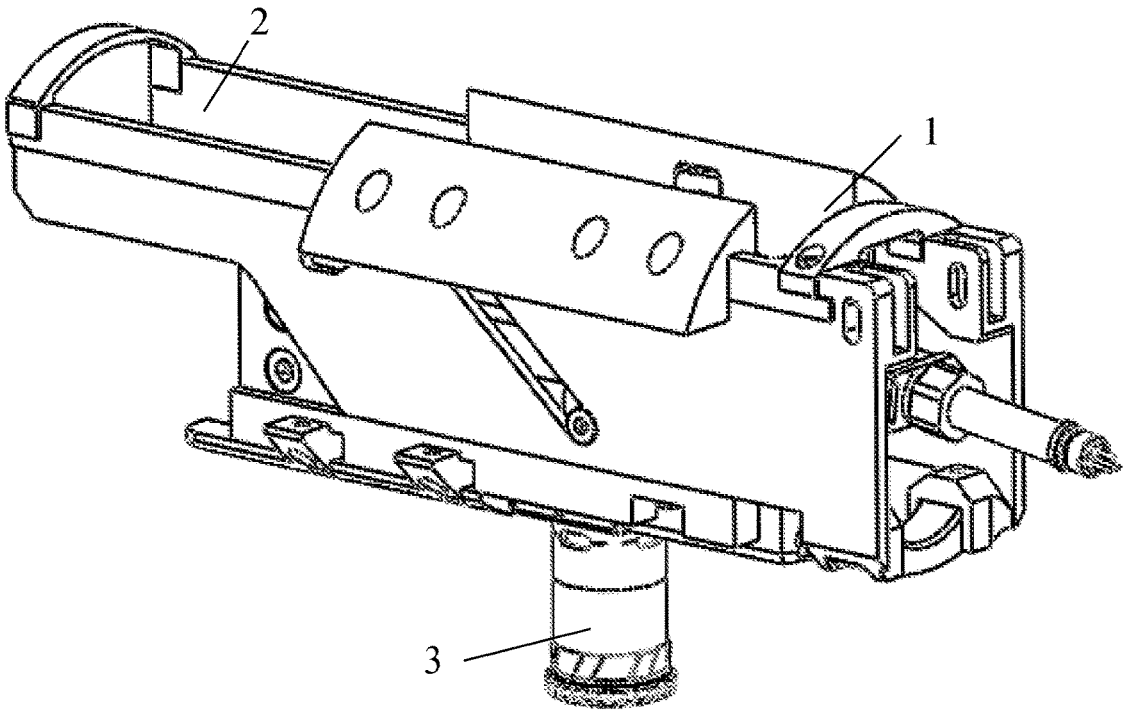
FIG. 6 is a schematic structural view of a state of the horizontal-to-vertical drilling module for a deep well shown in FIG. 1, which is performing the core breaking.

In order to better realize the turning of the coring module 3 from the vertical state to the horizontal state, as shown in FIGS. 5 and 8, the side of the movable plate 2 facing the fixed plate 1 is provided with a position constraining part 24. The position constraining part 24 is located at the end of the turning driving section 21 adjacent to the core breaking section 13, and the moving slider 4 is provided with a matching part. The open groove 41 is directly communicated with the turning section 11. The moving slider 4 is located at the end of the moving section 12 away from the core breaking section 13. When the turning driving section 21 drives the moving column 31 to slide out of the open groove 41 and move from the moving section 12 into the turning section 11, the matching part presses against the position constraining part 24. When the turning driving section 21 pushes the moving column 31 into the turning section 11, a component force toward the core breaking section 13 will be generated, and the position constraining part 24 prevents the moving slider 4 from moving along the moving section 12 toward the core breaking section 13. The position constraining part 24 is a position constraining boss and the matching part is a matching boss.

In an exemplary embodiment, as shown in FIG. 9, the first guide hole includes a vertically arranged first elongated hole and an arc-shaped hole located on the right side of the first elongated hole. The left end of the arc-shaped hole is communicated with the right side of the first elongated hole. The moving section 12 and the core breaking section 13 form the first elongated hole. The moving section 12 is located above the core breaking section 13, and the turning section 11 is located on the arc-shaped hole. The moving slider 4 is rotatably installed at the lower end thereof on the coring module 3, at the upper end thereof has an open groove 41 opened toward the right side. When the moving slider 4 moves to the upper end of the first elongated hole, the open groove 41 is communicated with the arc-shaped hole, and the center of the arc-shaped hole is located at the position where the moving slider 4 and the coring module 3 are rotatably connected, so that the moving column 31 moves into the arc-shaped hole around the position where the moving slider 4 and the coring module 3 are rotatably connected. The third guide hole 14 is arranged as a fourth elongated hole, and the right end of the fourth elongated hole is communicated with the left lower part of the first elongated hole.

In addition, as shown in FIG. 8, the second guide hole includes a second elongated hole extending obliquely upward from right to left and a third elongated hole extending obliquely upward from left to right. The upper end of the second elongated hole is communicated with the upper end of the third elongated hole. The moving driving section 22 is the second elongated hole, the core breaking driving section 23 is the right end hole wall of the second elongated hole, and the turning driving section 21 is the third elongated hole. The first direction is from left to right, and the direction opposite to the first direction is from right to left.

Furthermore, as shown in FIG. 8, a turning positioning section 25 is transversely extended from the left end of the third elongated hole towards the left. When the moving column 31 moves to the end of the turning section 11 remote from the moving section 12, the moving column 31 is also located in the turning positioning section 25, which ensures that the coring module 3 maintains in a horizontal state and smoothly pushes the core.

As shown in FIGS. 2 and 8, the fixed plate 1 is provided with a guide rail groove 15 arranged along the left-right direction, and the movable plate 2 is provided with a guide rail 26 arranged along the left-right direction. The guide rail 26 is movably installed in the guide rail groove 15 and can move in the left-right direction in the guide rail groove 15.

As shown in FIG. 1 and FIG. 2, each of the movable plate 2, the fixed plate 1, the moving slider 4 and the moving column 31 is arranged in each of two groups symmetrically arranged at the front and back sides of the coring module 3. The two fixed plates 1 are fixedly connected through a first cross beam 61, the two movable plates 2 are fixedly connected through a second cross beam 62, and the movable beam 51 is a U-shaped beam.

The movable plate 2 is driven by a linear driving component which can be any one of a hydraulic cylinder and equivalent structure thereof, all of which can achieve the purpose of the present disclosure and do not depart from the design idea of the present disclosure, therefore they are not repeatedly described herein, and should be within the protection scope of the present disclosure.

The specific actions can be as follows.

Turning action (which can be understood in conjunction with FIGS. 3, 4, 5, 8 and 9): the moving slider 4 is located at the upper end of the moving section 12, the moving column 31 is located in the open groove 41, the matching part is pressed against the position constraining part 24; by moving the movable plate 2 towards the right, the turning driving section 21 drives the moving column 31 to slide out of the open groove 41 and move from the moving section 12 towards the right into the turning section 11, and be located in the turning positioning section 25, thereby the coring module 3 is turned from a vertical state to a horizontal state; by moving the movable plate 2 towards the left, the turning driving section 21 drives the moving column 31 to move leftward from the turning section 11 to the moving section 12 and slide into the open groove 41, so that the coring module 3 is turned from a horizontal state to a vertical state.

Moving action (which can be understood in conjunction with FIGS. 3, 5, 7 to 9): the moving driving section 22 can drive the coring module 3 and the moving column 31 located in the open groove 41 to move together in the moving section 12 and the core breaking section 13. It can be the case that the movable plate 2 is moved leftward, then the moving driving section 22 drives the moving column 31 and the moving slider 4 together to move downward from the moving section 12 to the core breaking section 13 (at this point, the coring module 3 is in a vertical state). It can also be the case that the movable plate 2 is moved rightward, then the moving driving section 22 drives the moving column 31 and the moving slider 4 together to move upward from the core breaking section 13 to the moving section 12 (the coring module 3 is in a vertical state).

Core breaking action (which can be understood with reference to FIGS. 6 to 9): the moving slider 4 is located in the core breaking section 13 (the coring module 3 is in a vertical state), the moving column 31 is located in the open groove 41, the movable plate 2 continues to be pulled leftward, then the core breaking driving section 23 (at the right end of the moving driving section 22) pushes the moving column 31 leftward to press against the inner wall of the open groove 41 in the core breaking section 13 to perform core breaking action, and the coring module 3 turns slightly (the set angle can be 3-5 degrees, etc.) about its hinge axis where the coring module 3 is hinged with the moving slider 4 (the coring module 3 turns from a vertical state to an inclined state) to perform core breaking action. When the force pulling the movable plate 2 to the left is removed, the core breaking resetting module 5 pushes the moving slider 4 at the left side surface (i.e., the outer bottom surface 410 of the open groove 41, as shown in FIG. 7) of the upper end of the moving slider 4 towards the right, so that both the moving slider 4 and the coring module 3 are reset to the vertical state.

Optionally, the module further comprises a core breaking resetting module installed beside the core breaking section and arranged to reset the moving column and the moving slider after the core breaking.

Optionally, the core breaking resetting module comprises: a movable beam, wherein the fixed plate is also provided with a third guide hole communicated with the core breaking section, and the movable beam is movably installed in the third guide hole; and a resetting member connected to the end of the movable beam remote from the core breaking section; wherein when the moving slider is positioned in the core breaking section, the movable beam is pressed against an outer bottom surface of the open groove.

Optionally, the resetting member comprises: a positioning block fixedly connected with the fixed plate and provided with a piston cavity and a mounting cavity which are communicated with each other, wherein the mounting cavity is provided with an opening facing the movable beam; a piston movably and hermetically installed in the piston cavity; an elastic resetting piece installed in the mounting cavity; and a blocking piece movably and hermetically installed in the opening of the mounting cavity and tightly pressing the elastic resetting piece, wherein the movable beam is connected to the blocking piece.

Optionally, a position constraining part is provided on the side of the movable plate facing the fixed plate and is located at the end of the turning driving section adjacent to the core breaking section, the moving slider is provided with a matching part; wherein when the turning driving section drives the moving column to slide out of the open groove and move from the moving section into the turning section, the matching part is pressed against the position constraining part, and the position constraining part prevents the moving slider from moving to the core breaking section side along the moving section.

Optionally, the first guide hole comprises a first elongated hole vertically arranged and an arc-shaped hole positioned on the right side of the first elongated hole, wherein the left end of the arc-shaped hole is communicated with the right side of the first elongated hole, wherein the moving section is positioned on the upper part of the first elongated hole, the core breaking section is positioned on the lower part of the first elongated hole, and the turning section is positioned on the arc-shaped hole, and wherein the moving slider is rotatably mounted at the lower end thereof on the coring module, and is provided at the upper end thereof with the open groove opened toward the right side; wherein when the moving slider moves to the upper end of the first elongated hole, the open groove is communicated with the arc-shaped hole.

Optionally, the first guide hole comprises a first elongated hole vertically arranged and an arc-shaped hole positioned on the right side of the first elongated hole, wherein the left end of the arc-shaped hole is communicated with the right side of the first elongated hole, wherein the moving section is positioned on the upper part of the first elongated hole, the core breaking section is positioned on the lower part of the first elongated hole, and the turning section is positioned on the arc-shaped hole, and wherein the moving slider is rotatably mounted at the lower end thereof on the coring module, and is provided at the upper end thereof with the open groove opened toward the right side; wherein when the moving slider moves to the upper end of the first elongated hole, the open groove is communicated with the arc-shaped hole; the third guide hole is arranged as a fourth elongated hole, and the right end of the fourth elongated hole is communicated with the left lower part of the first elongated hole.

Optionally, the second guide hole comprises a second elongated hole extending obliquely upward from right to left and a third elongated hole extending obliquely upward from left to right, wherein the upper end of the second elongated hole is communicated with the upper end of the third elongated hole, and wherein the moving driving section is located at the left part of the second elongated hole, the core breaking driving section is located at the right part of the second elongated hole, and the turning driving section is located on the third elongated hole.

Optionally, a turning positioning section is transversely extended from the left end of the third elongated hole towards the left.

Optionally, the fixed plate is provided with a guide rail groove arranged in a left-right direction, and the movable plate is provided with a guide rail arranged in the left-right direction, and the guide rail is movably installed in the guide rail groove.

Optionally, the horizontal-to-vertical drilling module for a deep well comprises two groups of the movable plates, two groups of the fixed plates, two groups of the moving sliders and two groups of the moving columns, all of which are symmetrically arranged, wherein the two groups of the movable plates, the two groups of the fixed plates, the two groups of the moving sliders and the two groups of the moving columns are respectively positioned at the front and back sides of the coring module, and wherein the two groups of the fixed plates are fixedly connected through a first cross beam and the two groups of the movable plates are fixedly connected through a second cross beam.

In the horizontal-to-vertical drilling module for a deep well provided by the disclosure, the fixed plate is provided with a first guide hole having a turning section, a core breaking section and a moving section positioned between the turning section and the core breaking section. The movable plate is movably mounted on one side of the fixed plate and is provided with a second guide hole having a turning driving section, a core breaking driving section and a moving driving section positioned between the turning driving section and the core breaking driving section. The projection of the first guide hole on the movable plate intersects with the second guide hole. The coring module is positioned at the other side of the fixed plate and is provided with a moving column on the side facing the fixed plate. The moving column extends into the second guide hole through the first guide hole. The moving slider is installed in the first guide hole and rotatably connected to the coring module. The moving slider is provided with an open groove, and the moving column may slide into and out of the open groove.

The coring module may reciprocate in the moving section, the core breaking section, and the turning section repeatedly to perform coring action.

The moving slider is located at the end of the moving section adjacent to the turning section, and the moving column is located in the open groove. By moving the movable plate in the first direction, the turning driving section drives the moving column to slide out of the open groove and move from the moving section into the turning section, thereby the coring module is turned from a vertical state to a horizontal state. By moving the movable plate in the direction opposite to the first direction, the turning driving section drives the moving column to move from the turning section to the moving section and slide into the open groove, so that the coring module is turned from a horizontal state to a vertical state.

The moving driving section can drive the coring module and the moving column located in the open groove to move together in the moving section and the core breaking section. It can be the case that the moving column and the moving slider move together from the moving section to the core breaking section (the coring module is in a vertical state). It can also be the case that the moving column and the moving slider together move from the core breaking section to the moving section (the coring module is in a vertical state).

The moving slider is located in the core breaking section (the coring module is in a vertical state), the moving column is located in the open groove. The core breaking driving section drives the moving column to press against the inner wall of the open groove in the core breaking section for coring breaking, and the coring module turns about its hinge axis where the coring module is hinged with the moving slider so as to perform core breaking action.

To sum up, the horizontal-to-vertical drilling module for a deep well provided by the present disclosure is simple in structure and can realize the coring, core breaking, turning and core pushing actions, thereby meeting the usage requirement better.

In the description of the present disclosure, the terms "install", "communicate", "connect", "fix" and the like should be understood in a broad sense, for example, "connect" may refer to a fixed connection, a detachable connection, or an integral connection, or it can refer to be directly connected or indirectly connected through an intermediate medium. For those of ordinary skill in the art, the specific meanings of the above terms in this disclosure can be understood according to specific context.

In the description of this specification, the description of the terms "one embodiment", "some embodiments", "a specific embodiment" and the like means that a specific feature, structure, material, or characteristic described in connection with the embodiment or example is included in at least one embodiment or example of the present disclosure. In this specification, the schematic reference to the above-mentioned terms does not necessarily refer to the same embodiment or example. Moreover, the specific features, structures, materials, or characteristics described may be combined in any one or more embodiments or examples in a suitable manner.

While the embodiments of the application are disclosed as above, the above contents are merely embodiments employed for ease of understanding the present disclosure, and are not intended to limit the present disclosure. Any person skilled in the art to which this disclosure belongs can make any modification and change to the forms and details of the embodiments without departing from the spirit and scope of the present disclosure. The patent protection scope of the present disclosure shall be defined by the appended claims.

What we claim is:

1. A horizontal-to-vertical drilling module for a deep well comprising:

a fixed plate provided with a first guide hole having a turning section, a core breaking section and a moving section positioned between the turning section and the core breaking section;

a movable plate movably mounted on one side of the fixed plate and provided with a second guide hole having a turning driving section, a core breaking driving section and a moving driving section positioned between the turning driving section and the core breaking driving section, wherein a projection of the first guide hole on the movable plate intersects with the second guide hole;

a coring module positioned at the other side of the fixed plate and provided with a moving column on the side facing the fixed plate, wherein the moving column extends into the second guide hole through the first guide hole; and a moving slider having an open groove, wherein the moving slider is installed in the first guide hole and rotatably connected to the coring module, and wherein the moving column is able to slide into and out of the open groove;

wherein the coring module is movable in the moving section and the core breaking section;

wherein the turning driving section is able to drive the moving column to move from the turning section to the moving section and slide into the open groove, and is also able to drive the moving column to slide out of the open groove and move from the moving section into the turning section;

wherein the moving driving section is able to drive the coring module and the moving column positioned in the open groove to move together in the moving section and the core breaking section; and wherein the core breaking driving section is able to drive the moving column to press against an inner wall of the open groove in the core breaking section to perform core breaking.

2. The horizontal-to-vertical drilling module for a deep well according to claim 1, further comprising:

a core breaking resetting module installed beside the core breaking section and configured to reset the moving column and the moving slider after the core breaking.

3. The horizontal-to-vertical drilling module for a deep well according to claim 2, wherein the core breaking resetting module comprises:

a movable beam, wherein the fixed plate is further provided with a third guide hole communicated with the core breaking section, and the movable beam is movably installed in the third guide hole; and a resetting member connected to the end of the movable beam remote from the core breaking section;

wherein when the moving slider is positioned in the core breaking section, the movable beam is pressed against an outer bottom surface of the open groove.

4. The horizontal-to-vertical drilling module for a deep well according to claim 3, wherein the resetting member comprises:

a positioning block fixedly connected with the fixed plate and provided with a piston cavity and a mounting cavity which are communicated with each other, wherein the mounting cavity has an opening facing the movable beam;

a piston movably and hermetically installed in the piston cavity;

an elastic resetting piece installed in the mounting cavity; and a blocking piece movably and hermetically installed in the opening of the mounting cavity and tightly pressing the elastic resetting piece, wherein the movable beam is connected to the blocking piece.

5. The horizontal-to-vertical drilling module for a deep well according to claim 3, wherein the first guide hole comprises a first elongated hole vertically arranged and an arc-shaped hole positioned on the right side of the first elongated hole, wherein the left end of the arc-shaped hole is communicated with the right side of the first elongated hole, wherein the moving section is positioned on the upper part of the first elongated hole, the core breaking section is positioned on the lower part of the first elongated hole, and the turning section is positioned on the arc-shaped hole, and wherein the moving slider is rotatably mounted at the lower end thereof on the coring module, and is provided at the upper end thereof with the open groove opened toward the right side;

wherein when the moving slider moves to the upper end of the first elongated hole, the open groove is communicated with the arc-shaped hole;

the third guide hole is arranged as a fourth elongated hole, and the right end of the fourth elongated hole is communicated with the left lower part of the first elongated hole.

6. The horizontal-to-vertical drilling module for a deep well according to claim 1, wherein a position constraining part is provided on the side of the movable plate facing the fixed plate and is located at the end of the turning driving section adjacent to the core breaking section, and wherein the moving slider is provided with a matching part;

wherein when the turning driving section drives the moving column to slide out of the open groove and move from the moving section into the turning section, the matching part is pressed against the position constraining part, and the position constraining part prevents the moving slider from moving to the core breaking section side along the moving section.

7. The horizontal-to-vertical drilling module for a deep well according to claim 1, wherein the first guide hole comprises a first elongated hole vertically arranged and an arc-shaped hole positioned on the right side of the first elongated hole, wherein the left end of the arc-shaped hole is communicated with the right side of the first elongated hole, wherein the moving section is positioned on the upper part of the first elongated hole, the core breaking section is positioned on the lower part of the first elongated hole, and the turning section is positioned on the arc-shaped hole, and wherein the moving slider is rotatably mounted at the lower end thereof on the coring module, and is provided at the upper end thereof with the open groove opened toward the right side;

wherein when the moving slider moves to the upper end of the first elongated hole, the open groove is communicated with the arc-shaped hole.

8. The horizontal-to-vertical drilling module for a deep well according to claim 1, wherein the second guide hole comprises a second elongated hole extending obliquely upward from right to left and a third elongated hole extending obliquely upward from left to right, wherein the upper end of the second elongated hole is communicated with the upper end of the third elongated hole, and wherein the moving driving section is located at the left part of the second elongated hole, the core breaking driving section is located at the right part of the second elongated hole, and the turning driving section is located on the third elongated hole.

9. The horizontal-to-vertical drilling module for a deep well according to claim 8, wherein a turning positioning section is transversely extended from the left end of the third elongated hole towards the left.

10. The horizontal-to-vertical drilling module for a deep well according to claim 1, wherein the fixed plate has a guide rail groove arranged in a left-right direction, and the movable plate has a guide rail arranged in the left-right direction, and wherein the guide rail is movably installed in the guide rail groove.

11. The horizontal-to-vertical drilling module for a deep well according to claim 1, wherein the horizontal-to-vertical drilling module for a deep well comprises two groups of the movable plates, two groups of the fixed plates, two groups of the moving sliders and two groups of the moving columns, all of which are symmetrically arranged, wherein the two groups of the movable plates, the two groups of the fixed plates, the two groups of the moving sliders and the two groups of the moving columns are respectively positioned at the front and back sides of the coring module, and wherein the two groups of the fixed plates are fixedly connected through a first cross beam and the two groups of the movable plates are fixedly connected through a second cross beam.

* * * * *